United States Patent [19]

Rackley et al.

[11] 4,311,447

[45] Jan. 19, 1982

[54] RADIANT SURFACE COMBUSTOR

[75] Inventors: Ray A. Rackley, Phoenix, Ariz.; David V. Carpenter, Mendocino, Calif.

[73] Assignee: The Garrett Corporation, Los Angeles, Calif.

[21] Appl. No.: 106,296

[22] Filed: Dec. 21, 1979

Related U.S. Application Data

[62] Division of Ser. No. 916,161, Jun. 16, 1978, Pat. No. 4,280,329.

[51] Int. Cl.[3] ..... F23D 13/12

[52] U.S. Cl. ..... 431/7; 431/328; 126/92 AC

[58] Field of Search ..... 60/650, 682; 431/7, 431/326, 328; 126/92 A, 92 AC

[56] References Cited

U.S. PATENT DOCUMENTS

| | | | |
|---|---|---|---|
| 1,735,945 | 11/1929 | Wollaston | 126/92 C |
| 3,187,798 | 6/1965 | Pokorny | 431/347 |
| 3,916,869 | 11/1975 | Dufour | 431/328 X |
| 4,062,190 | 12/1977 | Dawson | 431/326 X |
| 4,087,962 | 5/1978 | Beremand et al. | 431/328 X |

*Primary Examiner*—Allen M. Ostrager
*Assistant Examiner*—Stephen F. Husar
*Attorney, Agent, or Firm*—Stuart O. Lowry; Albert J. Miller

[57] ABSTRACT

A radiant surface combustor comprising a porous combustor element in close heat transfer relation with a heat transfer surface for absorbing radiant heat energy from the combustor element.

23 Claims, 8 Drawing Figures

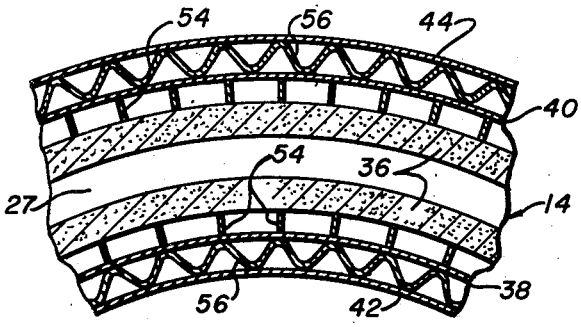
FIG. 2
FIG. 3
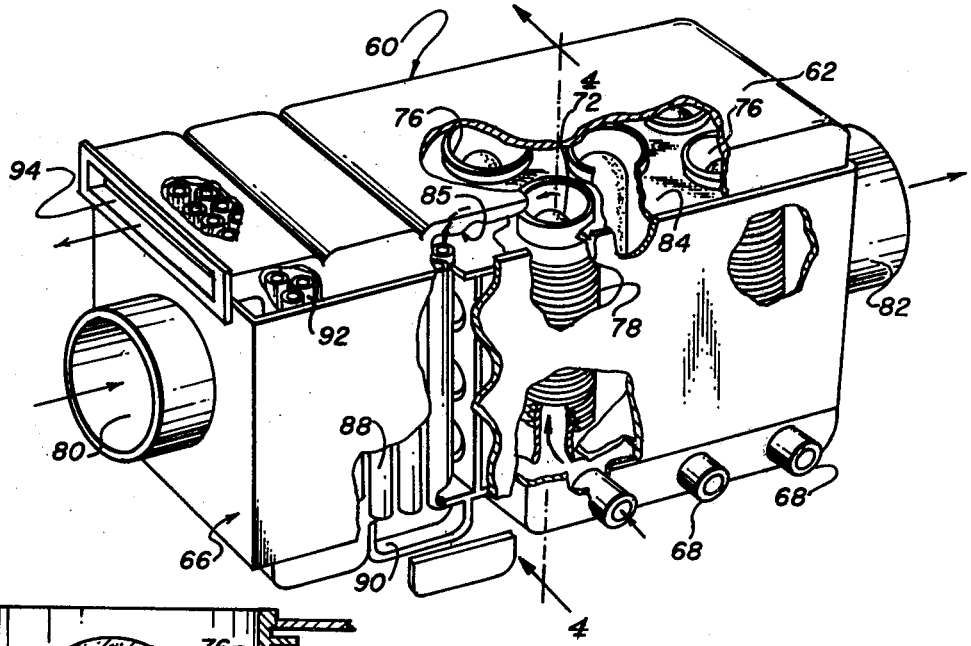
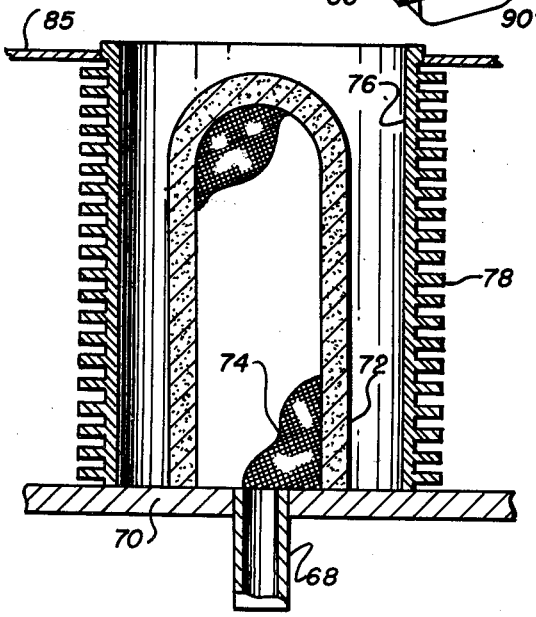
FIG 4

RADIANT SURFACE COMBUSTOR

This is a division of application Ser. No. 916,161 filed June 16, 1978 now U.S. Pat. No. 4,280,329.

BACKGROUND OF THE INVENTION

This invention relates to radiant surface combustors. More specifically, this invention relates to radiant surface combustors in combination with heat transfer surfaces for use in heat engines.

Heat engines in general are well known in the prior art, and typically comprise engines of either the open or closed cycle type wherein heat is transferred to an engine working fluid. For example, in an open cycle heat engine such as a gas turbine, a mixture of fuel and an oxidizer such as air is burned in a combustion chamber, and the burned products of combustion are used to heat an engine working fluid. Specifically, the products of combustion are mixed with excess air to form a heated working fluid which is expanded through an expansion turbine to obtain a work output. In a closed cycle heat engine, such as a steam engine, closed cycle Brayton engine, or the like, a fuel and air mixture is burned in a combustion chamber to generate heat for heating an engine working fluid, such as water or air, by heat exchange through a fixed boundary without intermixture between the combustion products and the working fluid.

A major problem with fuel-burning heat engines comprises the presence of noxious pollutants in the products of combustion. More specifically, combustion of the fuel is normally incomplete whereby polluting exhaust emissions such as unburned hydrocarbons, carbon monoxide, and oxides of nitrogen are present. In the prior art, heat engines have been designed to produce satisfactorily low levels of unburned hydrocarbons and carbon monoxide, but the levels of oxides of nitrogen have remained objectionably high. The presence of nitrogen oxides in the exhaust is largely due to the relatively long flame residence times and high flame temperatures, typically about 4000° R or more, of conventional flame propagation-type combustors.

In some prior art combustion applications, radiant surface combustors have been used in lieu of traditional flame propagation-type combustions, and have exhibited improved exhaust emission characteristics particularly with regard to the presence of oxides of nitrogen. That is, some prior art combustors have been proposed wherein a pressurized gaseous fuel-air mixture is forced through a porous combustor element, and wherein combustion occurs generally at the surface of the combustor element to produce primarily radiant heat energy. See, for example, U.S. Pat. Nos. 1,223,308; 3,027,936; 3,063,493; 3,155,142; 3,179,156; 3,191,659; 3,208,247; 3,217,701; 3,231,202; 3,275,497; 3,383,159; and 3,650,661. However, these prior art applications of radiant surface combustors have generally been limited to space-heater type applications. Radiant surface combustors have not been used with heat engines since they have been generally incapable of providing sufficient quantities of radiant heat energy at a sufficiently high temperature level for satisfactory operation of a heat engine.

The present invention overcomes the problem and disadvantages of the prior art by providing a radiant surface combustor for producing relatively large quantities of radiant heat energy, and for efficiently transferring the heat energy to the working fluid of the engine.

SUMMARY OF THE INVENTION

In accordance with the invention, a radiant surface combustor for a heat engine comprises a porous combustor element through which a gaseous fuel and air mixture is forced under pressure. The fuel-air mixture is ignited on the surface of the combustor element to produce a generally two dimensional, relatively short residence flame at the surface of the combustor element for producing relatively high quantities of radiant heat energy.

An extended surface heat transfer member such as a corrugated or finned surface is positioned in close proximity with the combustor element so as to efficiently absorb radiant heat energy emitted from the surface of the combustor element. The heat transfer member is designed to control the surface temperature of the combustor element at a sufficiently low level to correspondingly control the production of noxious pollutants such as nitrogen oxides, while at the same time absorbing large quantities of heat energy for transfer to the working fluid of the heat engine.

In one preferred embodiment of the invention, the heat engine comprises an open cycle engine wherein the products of combustion are mixed with excess air to form a heated working fluid for expansion through a turbine or the like. The heat transfer member surrounds the combustor element to absorb radiant heat therefrom, and to transfer the same to the excess air prior to intermixture with the combustion products. In another preferred embodiment, the engine comprises a closed cycle engine wherein the heat transfer member surrounds the combustor element to absorb heat therefrom, and to transfer the heat to the working fluid without intermixture between the working fluid and the products of combustion.

BRIEF DESCRIPTION OF THE DRAWINGS

The accompanying drawings illustrate the invention. In such drawings:

FIG. 2 is an enlarged fragmented vertical section taken on the line 2—2 of FIG. 1;

FIG. 3 is a perspective view of a radiant surface combustor of this invention for use in a closed cycle heat engine, with portions broken away;

FIG. 4 is an enlarged fragmented vertical section taken on the line 4—4 of FIG. 3;

DETAILED DESCRIPTION OF THE PREFERRED EMBODIMENT

Figure 1:
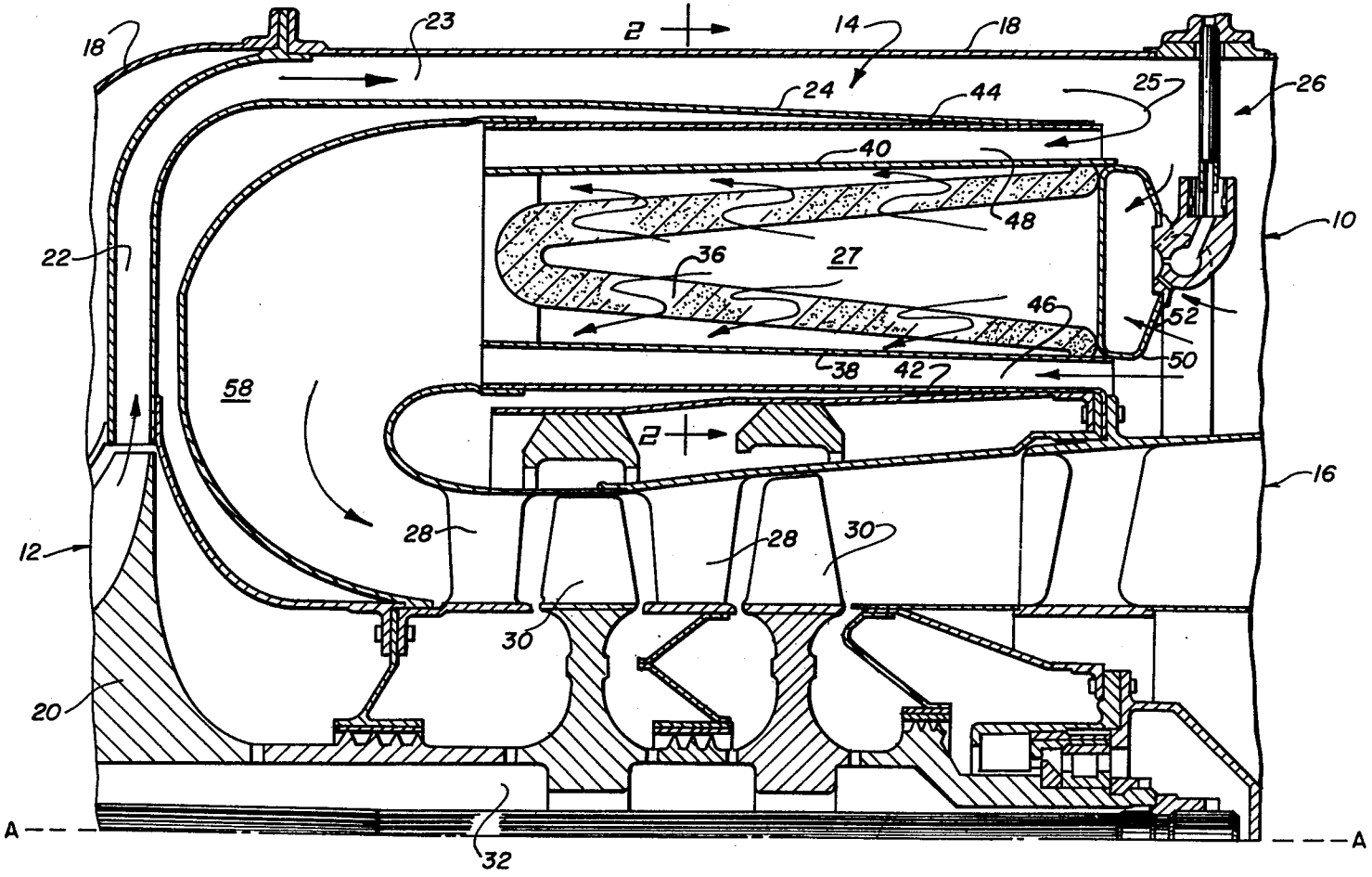
FIG. 1 is a fragmented section of a portion of an open cycle gas turbine engine, including a radiant surface combustor of this invention.

An open cycle gas turbine engine 10 is shown in FIG. 1, and generally comprises a compressor stage 12, a combustor section 14 encircling a power output section 16, all carried within an exterior housing 18. Importantly, since the engine is symmetrical about axis A—A of FIG. 1, only one-half of the engine is shown in the drawing.

In operation, air is drawn into the engine by the compressor section 12, and is compressed by one or more compressor impellers 20. The compressed air is discharged from the compressor section 12 through an outwardly radiating diffuser channel 22, and travels rearwardly through an annular flow path 23 formed by the exterior housing 18 and a concentrically disposed interior cylindrical wall 24. Near the rear of the engine, the compressed air is turned radially inwardly as indicated by arrows 25, and then forwardly for passage through the combustor section 14.

The combustor section 14 comprises an annular combustion chamber 27 defined by inner and outer cylindrical walls 38 and 40, respectively, for inlet and passage of a mixture of fuel and primary air, as will be hereafter described in more detail. Additional cylindrical walls 42 and 44 are radially spaced from the walls 38 and 40, respectively, to form a pair of annular flow paths 46 and 48 for passage of secondary or excess air through the combustor section 14. As shown, the combustion chamber 27 is covered at its upstream end by a cap 50 providing a mounting support for a plurality of fuel injector assemblies 26 which supply fuel to the combustion chamber 27. The cap 50 and the injector assemblies 26 include air passages 52 through which a portion of the compressed air passes into the combustion chamber for mixture with the fuel. The remaining portion of the compressed air comprises secondary or excess air, and passes through the combustor section 14 via the secondary flow paths 46 and 48.

As shown in FIGS. 1 and 2 a porous ceramic combustor element 36 is mounted within the annular combustion chamber 27, and spans radially between the cylindrical walls 38 and 40. More specifically, the combustor element 36 comprises a generally annular porous element, and has a generally V-shaped cross section extending axially with respect to the engine. That is, the combustor element 36 includes a pair of oppositely angled walls having an open end and a closed end, and is mounted so that the open end of the V-shaped cross section receives the fuel and so-called primary air supplied to the combustion chamber 27 via the fuel injector assemblies 26 and the cap openings 52. In this manner, the primary air and fuel are mixed substantially at stoichiometric proportion upstream of the combustor element 36, with the V-shaped construction promoting generally uniform surface velocity distribution of the mixture along the length of the combustor element 36. This assures that passage of the mixture through the combustor element is substantially uniform along the length of said element, and that the velocity of the mixture is sufficiently high through all portions of the combustor element to prevent a flame from flashing back into the interior of said element, as will be hereafter described.

The combustor element 36 is formed from a suitable ceramic-based material to include a controlled porosity for passage of the fuel-air mixture. Preferably, the element is formed from a zirconia, silicon carbide, or silicon nitride ceramic material which has been found satisfactory for withstanding temperatures of as high as about 3000° R. The combustor element 36 may be formed by a variety of techniques including, but not limited to, molding, casting with mechanically formed porous passages, and bonding irregularly shaped particles and/or fibers. The resulting porous element has a porosity, thickness and shape according to the particular heat engine environment to be encountered.

The fuel-air mixture is forced under the pressure of the compressed primary air through the combustor element 36, and is suitably ignited by ignition means (not shown) for sustained combustion on the downstream surface of the combustor element 36. As stated above, the V-shaped cross section of the combustor element assures a sufficiently high mixture velocity to prevent flame flash back. The mixture burns at the surface of the combustor-element 36 as a substantially two dimensional flame of extremely short residence time to generate relatively large quantities of radiant heat energy from the surface of the combustor element. This radiant heat energy is partially absorbed by the products of combustion passing through the element 36, as well as by the walls 38 and 40.

The cylindrical walls 38 and 40 are closely adjacent the downstream surface of the combustor element 36 for a substantial portion of the length thereof, and comprise heat absorbing surfaces for efficiently absorbing a major portion of the radiant heat energy generated on said downstream surface. As shown in FIG. 2, these walls are maintained in spaced relation with the combustor element 36 by a plurality of longitudinally extending heat-absorbing support fins 54. These fins 54 provide extending surfaces to assist the transfer of heat by radiation and convection to the secondary flow paths 46 and 48 which further include honeycombed or corrugated extended surface heat transfer members 56. Importantly, these heat transfer members 56 are configured to allow relatively free flow of secondary air through the passages 46 and 48. However, the members 56 also provide broad surface area for absorbing heat energy from the walls 38 and 40, and thereby enable the walls 38 and 40 to continue to effectively transfer heat energy away from the combustor element 36. That is, the fins 54 and the heat transfer members 56 efficiently absorb the heat energy, and transfer the absorbed heat energy to the secondary air within the flow paths 46 and 48. In this manner, the walls 38 and 40, and the fins 54 and heat transfer members 56 serve to maintain the flame temperature on the surface of the combustor element at a relatively low level, say on the order of about 2,500° R, to limit noxious pollutants such as oxides of nitrogen to acceptable levels.

In the open cycle engine of FIGS. 1 and 2, the products of combustion are discharged from the combustor section 14, and are mixed with the heated secondary air in a mixing zone 58 at the downstream end of the combustor section 14. From the mixing zone 58, the combustion products and secondary air comprise a combined engine working fluid which is supplied to the power output section 16 for expansion through a series of stator vanes 28 and turbine blades 30 to rotatably drive a power shaft 32, all in a well known manner.

An alternate embodiment of the invention is shown in FIGS. 3 and 4. The embodiment shown in these figures comprises a combustor section 60 of a closed cycle heat engine wherein two separate fluid paths are provided. That is, the products of combustion are used to heat an engine process fluid such as air, without intermixture with the process fluid.

As shown in FIGS. 3 and 4, the combustor section 60 for a closed cycle heat engine comprises an exterior housing 62 having a plurality of inlet pipes 68 for receiving a gaseous mixture of fuel and air. Each of the inlet pipes 68 supplies the fuel-air mixture through a base 70 upon which a plurality of upstanding cattail-like radiant surface combustors 72 are mounted. These combustors 72 each comprise a porous ceramic material, formed as described with regard to the previous embodiment, for passage of the fuel-air mixture outwardly therethough and ignition of the same on the exterior surface of the combustor to provide substantial quantities of radiant heat energy. More specifically, as shown in FIG. 4, each of these combustors 72 projects upwardly from the base 70 and may be conveniently supported upon a suitable structure such as a relatively coarse screen support member 74. If desired, the combustors 72 may be formed with converging cross sections, such as the combustor element 36 of FIG. 1, to promote uniform fuel-air velocity distribution along the length of the combustors and to insure a sufficient fuel-air velocity to prevent combustion flash back.

The combustors 72 are each received within concentrically spaced upstanding tubes 76 which carry exteriorly radiating, extended surface fins 78. With this construction, radiant heat energy from the surface of each combustor 72 is absorbed by the closely adjacent tubes 76 and fins 78 so as to provide close and efficient heat transfer therebetween. The tubes 76 project above an upper wall 84 to discharge the products of combustion into a plenum 85, and ultimately to atmosphere via an exhaust outlet 94, as will be hereafter described.

A process fluid for the engine, such as air, is supplied to the combustor section 60 through an inlet 80. The air passes through the combustor housing 62 to absorb the heat generated by the combustors 72 and absorbed by the tubes 76 and fins 78 prior to exiting the housing via an outlet 82. Importantly, the process fluid 80 is allowed to flow through the combustor housing 62 between the base 70 and the upper wall 84 so as to seal off communication between the process fluid and the products of combustion.

If desired, an additional heat transfer section 66 may be provided upstream of the radiant combustors 72. As shown, the products of combustion exiting the tops of the combustor tubes 76 are exhausted from the plenum 85 for downward flow through a plurality of upstanding heat transfer tubes 88. These tubes 88 are positioned along the flow path of incoming process fluid upstream of the combustor section whereby remaining heat in the products of combustion is transferred to the process fluid without mixing with the process fluid. The products of combustion in turn are collected in a lower plenum chamber 90 of the combustor housing, and then directed upwardly through a second set of heat transfer tubes 92 prior to exhaust through the exhaust outlet 94.

Figure 5:
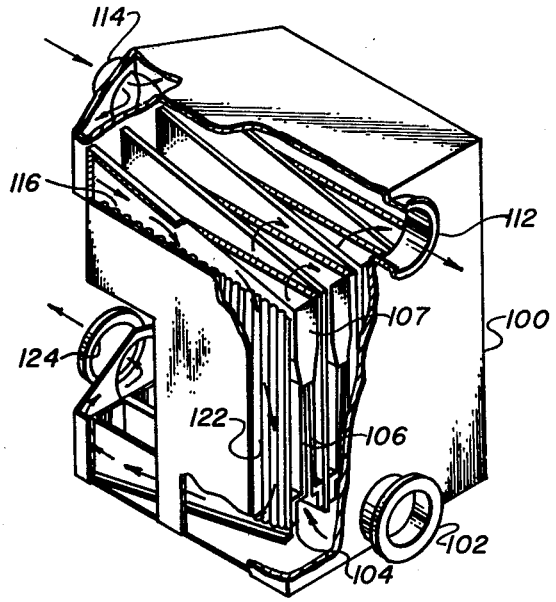
FIG. 5 is a perspective view of an alternate radiant surface combustor for use in a closed cycle heat engine, with portions broken away.
Figure 6:
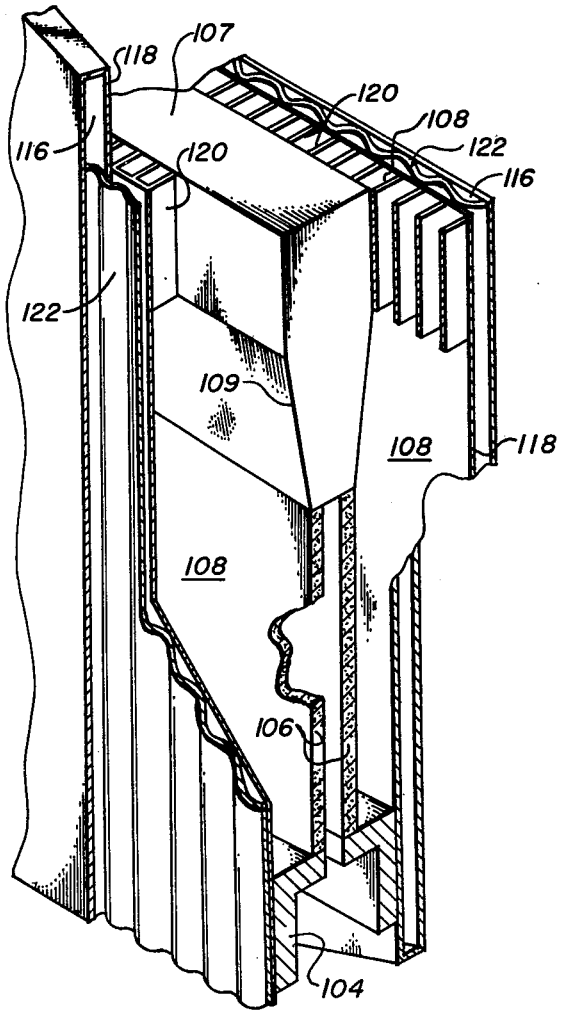
FIG. 6 is an enlarged fragmented perspective view of a portion of FIG. 5, with portions broken away.

Still another embodiment of the invention is shown in FIGS. 5 and 6. This embodiment comprises an alternaate closed cycle radiant surface combustor section for a heat engine wherein separate flow paths are provided for the products of combustion and an engine process fluid. More specifically, as shown in FIGS. 5 and 6, a fuel-air mixture is supplied to the interior of a combustor housing 100 through a lower opening 102. The fuel-air mixture is supplied to a plurality of longitudinally extending channels 104 at the base of the combustor housing 100, and from there upwardly between a pair of opposed ceramic porous combustor plates 106. The upper ends of the plates 106 are closed by a block 107 so that the fuel-air mixture is forced under pressure through the adjacent ceramic plates 106. The mixture is ignited on the downstream surfaces of the plates 106 for continued combustion thereon to provide relatively large quantities of radiant heat energy. From the plates 106, the resulting products of combustion pass upwardly through channels 108, and are forced outwardly by a tapered lower portion 109 of the block 107. The products of combustion pass further adjacent a series of upper heat transfer fins 120 in the housing 100, and then exhaust from the housing through an exhaust outlet 112.

A process fluid for the engine, such as air, is provided to the interior of the housing 100 through an inlet 114. From the inlet 114, the process fluid passes through downwardly directed flow channels 116 which are separated from the channels 108 as by impervious wall 118. These flow channels 116 include downwardly oriented extended surface honeycombed or corrugated heat transfer fins 122 for transfer of absorbed heat to the engine working fluid prior to discharge of the working fluid as through a lower outlet 124.

In operation, the fuel-air mixture is ignited on the downstream surfaces of the ceramic plates 106 to produce substantial radiant heat energy A major portion of this heat energy is radiantly absorbed by the adjacent impervious walls 118 for transfer to the working fluid via the heat transfer fins 122. The still hot products of combustion passing through the plates 106 are caused to scrub against the walls 118 by the tapered block surfaces 109 for further heat transfer to the working fluid. The upper heat transfer fins 120 then absorb additional heat from the combustion products and transfer the same to the working fluid prior to exhaustion of the combustion products from the housing.

Figure 7:
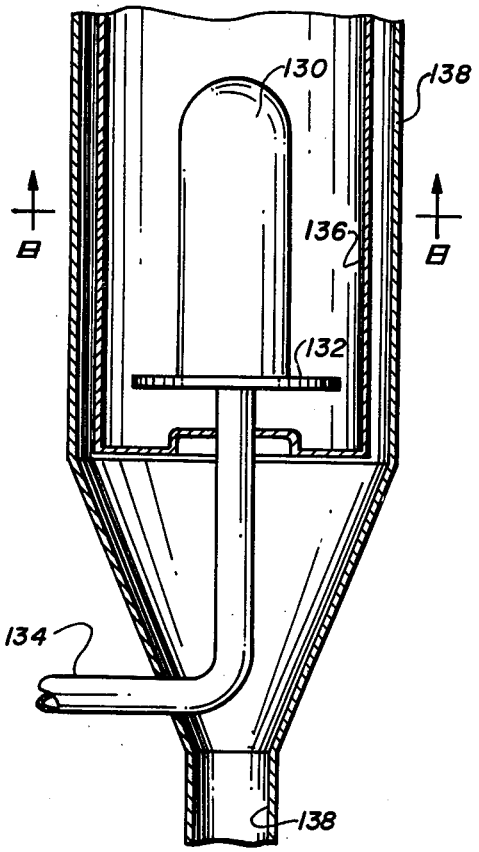
FIG. 7 is a fragmented vertical section of another embodiment of the invention.
Figure 8:
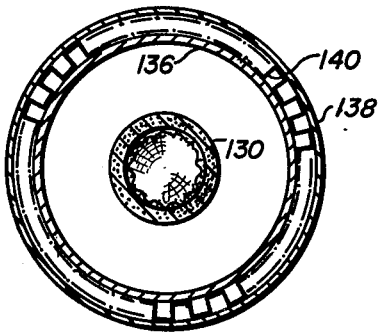
FIG. 8 is a horizontal section taken on the line 8—8 of FIG. 7.

Still another radiant surface combustor embodiment is shown in FIGS. 7 and 8. As shown, an upstanding cattail-type porous ceramic surface combustor 130 is supported on a base plate 132 through which a gaseous supply of a fuel-air mixture is provided as by supply pipe 134. The fuel-air mixture passes through the ceramic combustor 130 for continued radiant combustion on the downstream surface thereof in the same manner as described with respect to the previous embodiments. The radiant heat energy generated thereby is transferred to a concentrically disposed cylindrical wall 136 surrounding the combustor.

A process fluid such as air is ducted adjacent the combustor 130 through a duct 138. The duct 138 guides the process fluid concentrically about the wall 136 so that radiant heat absorbed by the wall is effectively transferred to the process fluid. Importantly, as shown in FIG. 8, an elongated, extended surface fin element 140 is carried within the duct 138 and about the wall 136 so as to improve heat transfer between the combustor 130 and the process fluid. From the duct 138, the heated process fluid may be mixed with the products of combustion as in an open cycle engine, or may be maintained separate from the products of combustion as by suitable ducting for use in a closed cycle engine.

A wide variety of modifications and improvements of the radiant surface combustor embodiments disclosed herein are believed to be possible within the scope of the art. For example, any of the embodiments may be adapted with a converging-wall combustor element construction so as to assure uniform fuel-air mixture velocity distribution and to prevent flame flash back. Accordingly, the embodiments are intended by way of example, and no limitation is intended except by way of the appended claims.

What is claimed is:

1. A radiant surface combustor for supplying heat energy to the working fluid of a heat engine, comprising a porous combustor element including a pair of spaced porous plates; means for supplying fuel and air to adjacent sides of said plates for passage therethrough and combustion at the opposite sides thereof to produce primarily radiant heat energy; and an extended heat transfer surface in close proximity with said other side of said combustor element for absorbing the generated heat energy, said heat transfer surface being in heat exchange relation with the working fluid for transferring the absorbed heat energy to the working fluid.

2. A radiant surface combustor as set forth in claim 1 wherein said combustor element is formed from a high temperature, porous ceramic material.

3. A radiant surface combustor as set forth in claim 1 including a combustor housing member having an inlet for receiving the fuel and air, and a discharge outlet for discharge of products of combustion resulting from combustion of the fuel and air at said other side of said combustor element, said combustor element being mounted within said housing member for passage of the fuel and air therethrough.

4. A radiant surface combustor as set forth in claim 1 wherein said extended heat transfer surface comprises a plurality of heat transfer fins mounted adjacent said combustor element.

5. A radiant surface combustor as set forth in claim 1 wherein said extended heat transfer surface comprises a wall mounted adjacent said combustor element, and an extended surface heat transfer member mounted on said wall.

6. A radiant surface combustor as set forth in claim 1 including a combustor housing member having a first flow path for flow of fuel and air, said combustor element being mounted along said first flow path, and a second flow path for flow of the working fluid, said extended heat transfer surface forming a boundary between said first and second flow paths.

7. A radiant surface combustor for supplying heat energy to a fluid, comprising a combustor housing having an inlet for receiving fuel and air for combustion therein, and a discharge outlet for discharge of combustion products resulting from combustion of the fuel and air; a porous combustor element mounted within said housing for passage of the fuel and air, and combustion at the downstream surface thereof to produce primarily radiant heat energy, said element comprising a pair of spaced porous plates having their adjacent sides in communication with the housing inlet and their opposite sides in communication with the discharge outlet; and wall means forming a flow path closely adjacent said element for passage of the fluid to be heated, said wall means forming an extended surface heat transfer boundary for absorbing heat energy from said element and including means for transferring the same to the fluid within the flow path.

8. A radiant surface combustor as set forth in claim 7 wherein said combustor element is formed from a high temperature, ceramic material, and wherein said combustion at the downstream surface thereof produces primarily radiant heat energy.

9. A radiant surface combustor as set forth in claim 7 wherein said means for transferring the absorbed heat energy to the fluid comprises a plurality of heat transfer members mounted on said wall means in heat exchange relation between the fluid in said flow path and said wall means.

10. A radiant surface combustor as set forth in claim 7 further including means for guiding the combustion products into convective heat transfer relation with said wall means prior to discharge from the housing through the discharge outlet.

11. A radiant surface combustor as set forth in claim 10 wherein said guide means comprises a tapered block for causing the combustion products to scrub said wall means.

12. A radiant surface combustor as set forth in claim 10 wherein said guide means comprises a plurality of heat transfer fins in heat exchange communication between the combustion products and said wall means.

13. A radiant surface combustor for supplying heat energy to the working fluid of a heat engine, comprising a combustor housing having an inlet for receiving fuel and air for combustion therein, and a discharge outlet for discharge of combustion products resulting from combustion of the fuel and air; a porous combustor element mounted within said housing for passage of the fuel and air and combustion at the downstream surface thereof to produce primarily radiant heat energy, said element comprising a pair of spaced porous plates having their adjacent sides in communication with the housing inlet and their opposite sides in communication with the discharge outlet; wall means forming a flow path adjacent said housing for passage of a fluid to be heated, said wall means forming a heat transfer boundary in close proximity with said element for absorbing the radiant energy; and heat transfer means within said flow path in heat transfer relation between said wall means and the fluid for transferring the absorbed radiant energy to said fluid.

14. A radiant surface combustor as set forth in claim 13 wherein the fluid comprises the working fluid for the engine.

15. A radiant surface combustor for supplying heat energy to the working fluid of a heat engine, comprising means forming a flow path for a fluid; a plurality of housing members each mounted within said flow path and including an inlet for receiving fuel and air for combustion therein, and a discharge outlet for discharge of the combustion products resulting from combustion of the fuel and air; a plurality of porous combustor elements each comprising a pair of spaced, porous plates having their adjacent sides in communication with the associated housing member inlet, and their opposite sides in communication with the associated discharge outlet, and each mounted in one of said housing members for passage of the fuel and air, and combustion at the downstream surface thereof for producing primarily radiant heat energy, said housing members forming heat transfer surfaces in close proximity with said elements for absorbing the radiant energy; and heat transfer means on said housing members for absorbing the heat energy from said housing members and for transferring the same to the fluid.

16. A radiant surface combustor method for supplying heat energy to the working fluid of a heat engine, comprising the steps of forming a combustor element from a pair of spaced porous plates for receiving fuel and air at their adjacent sides for passage therethrough and combustion at their opposite sides; supplying fuel and air to one side of the porous combustor plates for passage therethrough and combustion at the other sides thereof to produce primarily radiant heat energy; and positioning an extended heat transfer surface in close proximity with the other sides of said combustor plates for absorbing the generated heat energy, and in heat exchange relation with the working fluid for transferring the absorbed heat energy to the working fluid.

17. The method of claim 16 including the step of forming the combustor element from a high temperature, porous ceramic material.

18. The method of claim 16 including the steps of mounting the combustor element in a housing member, positioning the housing member in heat exchange relation with the working fluid, said housing member serving to absorb the radiant energy, and mounting heat transfer means in heat exchange relation between said housing member and fluid for transferring the absorbed heat to the fluid.

19. A radiant surface combustor method for supplying heat energy to a fluid, comprising the steps of forming a first flow path for receiving fuel and air; forming a combustor element from a pair of spaced porous plates for receiving fuel and air at their adjacent sides for passage therethrough and combustion at their opposite sides; mounting the porous combustor plates along said first flow path for passage of the fuel and air, and combustion at the downstream surfaces thereof to produce primarily radiant heat energy; forming a second flow path adjacent said first path for flow of the fluid; and providing an extended surface heat transfer boundary between said flow paths for absorbing the generated heat energy and for transferring the same to the fluid.

20. The method of claim 19 including the step of guiding the products of combustion in said first flow path into convective heat exchange communication with said heat transfer boundary.

21. A radiant surface combustor method for supplying heat energy to the working fluid of a heat engine, comprising the steps of mounting a porous combustor element in a housing having an inlet and a discharge outlet, said element including a pair of spaced porous plates; supplying fuel and air to adjacent sides of the combustor plates for passage therethrough and combustion at the downstream surfaces thereof to produce primarily radiant heat energy; forming a flow path with wall means closely adjacent said element for passage of a fluid to be heated and for absorbing the radiant energy; providing heat transfer means within said flow path in heat transfer relation between the wall means and the fluid for transferring heat absorbed by the wall means to the fluid; and guiding combustion products downstream of the combustor element into convective heat exchange relation with said heat transfer means.

22. A radiant surface combustor for supplying heat energy to a fluid, comprising a combustor housing having an inlet for receiving fuel and air for combustion therein, and a discharge outlet for discharge of combustion products resulting from combustion of the fuel and air; a porous combustor element mounted within said housing for passage of the fuel and air, and combustion at the downstream surface thereof to produce primarily radiant heat energy, said element comprising a pair of spaced porous plates having their adjacent sides in communication with the housing inlet and their opposite sides in communication with the discharge outlet; wall means forming a flow path for passage of the fluid to be heated and forming an extended surface heat transfer means closely adjacent said element for absorbing the radiant heat energy and for transferring the absorbed heat energy to the fluid within the flow path; and guide means including a tapered block for guiding the combustion products into scrubbing heat transfer relation with said wall means prior to discharge of the combustion products through the discharge outlet.

23. A radiant surface combustor as set forth in claim 22 further including a plurality of heat transfer fins in heat exchange communication between said block and said wall means.

* * * * *